United States Patent [19]

Pellman et al.

[11] Patent Number: 4,968,358

[45] Date of Patent: Nov. 6, 1990

[54] VAPOR PHASE UPHILL QUENCHING OF METAL ALLOYS USING FLUOROCHEMICALS

[75] Inventors: Mark A. Pellman, Orefield; Paul T. Kilhefner, III; Willliam J. Baxter, both of Wescosville; Terrence S. Hahn, Allentown, all of Pa.

[73] Assignee: Air Products and Chemicals, Inc., Allentown, Pa.

[21] Appl. No.: 427,165

[22] Filed: Oct. 25, 1989

Related U.S. Application Data

[63] Continuation-in-part of Ser. No. 320,018, Mar. 7, 1989, abandoned.

[51] Int. Cl.[5] ..... C22F 1/02

[52] U.S. Cl. ..... 148/20.3; 148/125

[58] Field of Search ..... 148/20.3, 13.2, 16, 148/16.7, 18, 13.1, 20.6, 125

[56] References Cited

U.S. PATENT DOCUMENTS

| | | | |
|---|---|---|---|
| 2,459,780 | 1/1949 | McBee | 260/648 |
| 2,549,686 | 10/1985 | Sargent et al. | 228/242 |
| 2,949,392 | 8/1960 | Willey | 148/125 |

FOREIGN PATENT DOCUMENTS

| | | |
|---|---|---|
| 2110204 | 6/1983 | United Kingdom . |
| 2194231 | 3/1988 | United Kingdom . |

OTHER PUBLICATIONS

"Uphill Quenching of Aluminum: Rebirth of a Little--Known Process"; by Tom Croucher in *Heat Treating;* Oct. 1983; pp. 30–32.

"The Thermal Mechanical Method for Relieving Residual Quench Stresses in Aluminum Alloys"; by H. M. Hill, R. S. Barker, L. A. Wiley in *Transactions of the American Society for Metals;* vol. 52; 1959.

"Development of Stress Relief Treatments for High Strength Aluminum Alloys"; from a NASA Quarterly Progress Report; Contract No. NAS8-11091; 1964; Manlabs, Inc.

"Polycyclic Fluoroaromatic Compounds III"; by D. Harrison, M. Stacey, R. Stephens, J. C. Tatlow in *Tetrahedron;* 1963; vol. 19; pp. 1893 & 1899.

*Primary Examiner*—R. Dean

*Attorney, Agent, or Firm*—Geoffrey L. Chase; James C. Simmons; William F. Marsh

[57] ABSTRACT

Uphill quenching of metal alloys, such as aluminum alloys, is improved by conducting the heating step, after the quench-cooling step of the uphill quenching, using the elevated temperature vapor of a fluorochemical compound, preferably a perfluorocarbon compound. The vapor formed over a boiling bath of the perfluorocarbon compound comprises the heat source when it condenses on the relatively cooler alloy thus imparting its heat of condensation to the alloy.

19 Claims, 4 Drawing Sheets

UPHILL QUENCH DATA
RUN I

UPHILL QUENCH DATA
RUN II

UPHILL QUENCH DATA
RUN III

VAPOR PHASE UPHILL QUENCHING OF METAL ALLOYS USING FLUOROCHEMICALS

The present invention is a continuation-in-part of Ser. No. 07/320,018 filed Mar. 7, 1989, now abandoned.

TECHNICAL FIELD

The present invention directed to the process of uphill quenching of metal alloys subsequent to solution heat treatment and quenching in the precipitation hardening process. More specifically, the present invention is directed vapor phase heating using perfluorinated fluids as the accelerated heating medium for uphill quenching of aluminum alloys.

BACKGROUND OF THE PRIOR ART

Metal alloys are heat treated to produce desirable mechanical properties. Commercially, most aluminum alloys are heated to a temperature of approximately 500° C. (932° F.) and then water quenched. In all of the heat treated alloys, especially those of substantial cross-section, a thermal gradient is produced inside the alloy. The thermal gradient is a result of the surface of the alloy cooling at a much faster rate than the interior of the alloy. As the alloy cools to a uniform temperature, the thermal gradient is removed, but it is replaced by a system of residual stresses.

For applications where the residual stresses must be removed, an uphill quench can be administered to the alloy subsequent to solution heat treatment and traditional quenching. Uphill quenching is a two part thermomechanical process by which the alloy to be stressed-relieved is cooled, preferably to cryogenic temperatures, and then rapidly heated. This reverse thermal cycle produces mechanical plastic deformation which relieves the residual stress.

The ability to relieve residual stress is also a function of the center to surface temperature differential which can be achieved in the alloy part, with the largest temperature differential relieving the greatest percentage of stress. This result is set forth in an article "Uphill Quenching of Aluminum Rebirth of a Little-Known Process" by Tom Croucher in *Heat Treating*, October 1983, pages 30 through 32. In that article, FIG. 2 demonstrates the varying efficacies of different uphill quench processes that are dependent upon temperature differential and apparently the capacity of heat transfer or heat exchange. The technique of relieving residual stress by the uphill quench process was developed more than 20 years ago. However, its full potential has never been realized due to the physical limitations associated with the conventional steam jet apparatus, which constitutes the present accelerated heating technique in the uphill quenching cycle.

As recorded in the article by Croucher identified above, engineers at Alcoa in the late 1950s identified a desirable uphill quench technique using liquid nitrogen and high velocity steam. The use of high velocity steam presents problems for practical application of uphill quenching of metal alloys of differing size and configuration. The arrangement of steam spray nozzles has been reported to be critical to the effectiveness of this uphill quenching technique. The arrangement is costly and time consuming. In addition, conventional methods only allow for the treatment of one part at a time. Overall, the cost of the uphill quench process is very high as a result of low output rates coupled with the high capital costs associated with installing a high pressure steam boiler and extensive piping. In addition, steam spray nozzles do not heat the part uniformly due to their directional nature. Therefore, upon subsequent machining there is a greater chance for distortion from this form of uphill quenching. Steam spray nozzles are also difficult to align for varying part configuration or dimensions. Finally, the thermal driving force or temperature differential between the center and surface of the part is limited when steam spray nozzles are utilized in light of the physical limitations associated with high pressure steam systems. As a result, the state of the art using liquid nitrogen and high velocity steam is prohibitively expensive and does not lend itself to continuous or multi-part processing, particularly of parts of differing dimension or configuration.

Other discussions of uphill quenching are presented in an article by H. M. Hill, R. S. Barker and L. A. Willey, titled, "The Thermal Mechanical Method for Relieving Residual Quench Stresses in Aluminum Alloys" appearing in Transactions of the American Society for Metals, Volume 52, 1959, as well as an article, "Development of Stress Relief Treatments for High Strength Alumin Alloys", appearing in a quarterly NASA Progress Report, Contract No. NAS8-11091, 1964, Manlabs, Inc.

U.S. Pat. No. 2,949,392 describes an uphill quench technique that preferably uses superheated steam to reduce residual stress in light metals.

Various fluorocarbons are known in the prior art, such as those recited in U.S. Pat. No. 2,459,780, which describes the heat transfer capabilities of fully fluorinated and fully saturated carbon compounds.

These compounds are additionally disclosed in Tetrahedran, 1963, Volume 19, page 1893 through 1899 and in an article entitled "Polycyclic Fluoroaromatic Compounds III", Harrison, et al.

The use of heating solder for vapor phase soldering using fluorocarbons has been disclosed in U.K. patent application No. GP2110204A.

Additional fluorocarbons useful for vapor phase soldering are identified in U.K. patent application No. GP2194231A.

The use of perfluorotetradecahydrophenanthrene has been set forth in U.S. Pat. No. 4,549,686.

The present invention overcomes the drawbacks of the prior art by providing uniform, easily adaptable, continuous, multi-part uphill quenching processes, which provide for large temperature differentials and avoidance of undue mechanical adaptations, or toxic and unstable process material, as set forth below.

BRIEF SUMMARY OF THE INVENTION

The present invention is a process for uphill quenching of metal alloys to relieve residual stresses, the improvement comprising, after quench-cooling the metal alloy, heating the metal alloy by the elevated temperature vapor of a fluorochemical compound.

Preferably, the metal alloy has initially been solution heat treated and quenched.

Preferably, the metal alloy is a aluminum alloy.

Preferably, the fluorochemical is perfluorocarbon.

Preferably, the perfluorocarbon is selected from the group consisting of perfluorodecalin, perfluoromethyldecalin, perfluorodimethyldecalin, perfluoroisopropyldecalin, perfluorotetradecahydrophenanthrene, perfluorodiisopropyldecalin and perfluoro-1,1-bis(3,4-dimethylcyclohexyl)ethane.

Preferably, the metal alloy is selected from the group consisting of 2XXX aluminum alloys, 6XXX aluminum alloys, and 7XXX aluminum alloys. Preferably, the metal alloy is selected from the group consisting of aluminum alloyed with copper, aluminum alloyed with magnesium and silicon, and aluminum alloyed with zinc magnesium and copper.

Preferably, the uphill quenching is performed at a maximum temperature up to the range of approximately 148.89° to 176.67° C. (300° to 350° F.).

Preferably, the fluorochemical compound is perfluoromethyldecalin.

Alternatively, the metal alloy is selected from the group consisting of 2XX aluminum cast alloys, 3XX aluminum cast alloys and 7XX aluminum cast alloys.

Preferably, the uphill quenching of the present invention is performed after an initial solution heat treatment and an initial quenching of the alloy.

Preferably, the quench-cooling is performed with a cryogen. Typically, the quench-cooling is performed with liquid nitrogen. If a theoretical maximum temperature is desired, the preferred cryogen would be liquid helium.

Preferably, the uphill quenching is conducted at a maximum temperature below the temperature for artificial aging of the metal alloy to be treated.

DETAILED DESCRIPTION OF THE DRAWINGS

Figure 4:
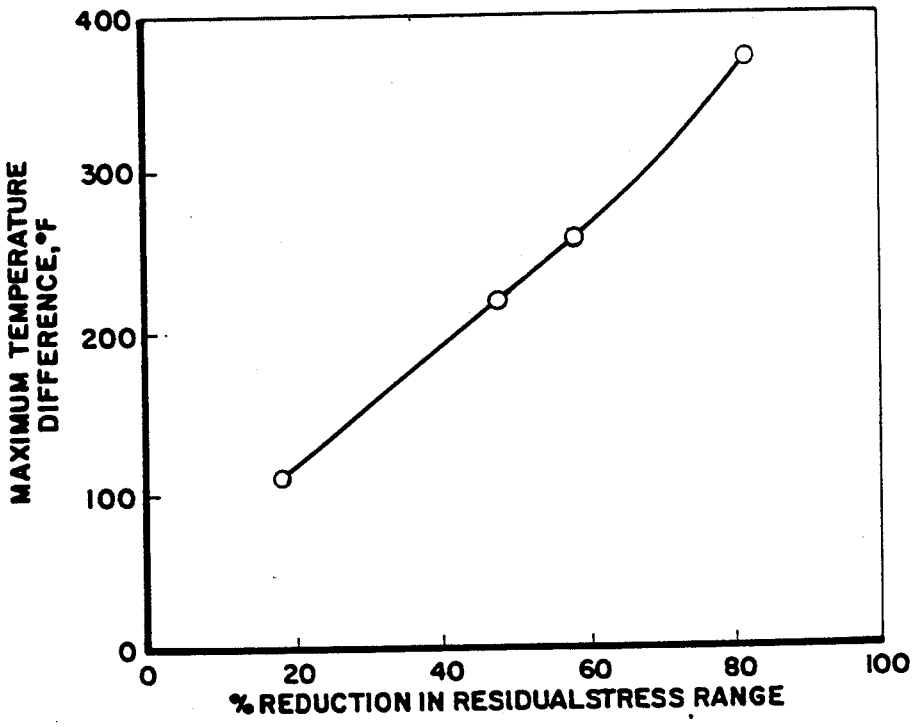

FIG. 4 is a graphical representation of the relationship of percent reduction in residual stress versus maximum temperature differential between the center and surface of an alloy being treated using uphill quenching as taken from the article "The Thermal Mechanical Method for Relieving Residual Quench Stresses in Aluminum Alloys" appearing in Transactions of the American Society for Metals, Vol. 52, 1959, by H. N. Hill, et al.

DETAILED DESCRIPTION OF THE INVENTION

Metal alloys, such as aluminum alloys, have traditionally been subject to treatments for enhancing properties, such as strength and hardness Such metal alloys are typically precipitation strengthened or hardened to create heat treated alloys of dense and defined dispersions of precipitated particles in a matrix of deformable metal. The precipitate particles act as obstacles to dislocation movement and thereby strengthen the heat treated alloy. The treatment is known to include a solution heat treatment to create a uniform solid solution structure in the metal alloy. The metal alloy is then quenched, typically with cooling water, to room temperature to produce a super saturated solid solution. When residual stresses are insignificant or unimportant, the metal alloy is then aged either by natural aging at ambient temperatures or artificial aging at elevated temperatures to form finely dispersed precipitates. These fine precipitates in the alloy impede dislocation movement during deformation by forcing the dislocations to either cut through the precipitate particle or go around them, thereby strengthening the alloy.

However, in metal alloys wherein the residual stresses after quenching are high or where the end use application dictates the removal of such residual stresses, it has traditionally been the practice to perform an uphill quench between the quench following the solution heat treatment and the natural or artificial aging. Uphill quenching after the initial quench to form a single phase solid solution involves a two-step process of further quench-cooling, most typically below the temperature of the initial quench, followed by rapid heating using high surface to center temperature differentials to a temperature below the aging temperature of the alloy being treated, most particularly the artificial aging temperature of such alloy. Uphill quenching is described in U.S. Pat. No. 2,949,392, the entire text of which is hereby incorporated herein by reference.

Alloys susceptible to such treatment include the wrought and forged aluminum alloys designated: 2XXX, 6XXX, and 7XXX and the cast aluminum alloys designated: 2XX, 3XX and 7XX. The 2XXX alloy aluminum is principally alloyed with copper. The 6XXX alloy aluminum is principally alloyed with magnesium and silicon. The 7XXX aluminum alloy is principally alloyed with zinc, magnesium and copper. The 2XX cast aluminum alloy is principally alloyed with copper. The 3XX cast aluminum alloy is principally alloyed with silicon and copper or silicon and magnesium or silicon, magnesium and copper. The 7XX cast aluminum alloy is principally alloyed with zinc, magnesium and copper.

These designations for cast and wrought aluminum and aluminum alloys are well known in the art, such as in Metals Handbook, desktop edition by Howard E. Foyer and Timothy L. Gall, American Society for Metals, Metals Park, OH, Chapter on Aluminum, 6-8 through 6-19 and 6-23. The designation to 2XXX, 6XXX and 7XXX for wrought and forged alloys and 2XX and 3XX and 7XX for cast alloys is further demonstrated to be a well recognized nomenclature in the prior art by reference to "Structure and Properties of Engineering Materials", Brick, Perse and Gordon, McGraw-Hill, 1977, chapter on Aluminum Alloys, page 187 through 191, 193 through 198.

Metal alloys, such as high strength aluminum alloys, attain their strength through heat treatment. While the specific treatment depends on the particular alloy being treated, most parts are quenched in water from a solution heat treating temperature usually in the range of from 870° F. (465° C.) to 1,000° F. (537° C.). During the quench, alloy surfaces cool faster than the alloy interior. Temperature gradients are created, causing different areas of the alloy to contract at different rates. Contraction of the more rapidly cooling surface compresses the interior, which plastically deforms to conform to the shrunken exterior. As the center cools to the same temperature as the surface, it attempts to contract, but by this time the surface metal is cold and not very plastic. As a result, it is under an elastic compressive stress, and since the rigidity of the surface prevents the interior obtaining its stable dimension, there is a balancing tensile stress in the central region. A development of residual stress or macro stresses as a result of differential plastic deformation caused by the thermal gradients of quenching are a significant problem for the use of aluminum alloys in high performance applications. During the later stages of cooling, these gradients disappear, but their presence sets up a the uneven distribution of residual stresses described above. These residual quenching stresses are the major cause of alloy instability during subsequent machining operations and can often cause stability problems later, while the alloy is in service.

In the ideal case, these residual stresses are compressive on the alloy surface, which cools first and tensile in the slower-cooling interior. The magnitude and distribution of the final stress varies with the particular alloy, thickness of the alloy part and especially the severity of the quench. After the quench, the tensile and compressive stresses present in the alloy are completely balanced resulting in a total net stress that equals zero for the entire alloy. If the net stress were not zero, the alloy would have to move in the direction of the larger stress until a complete balance were obtained and the alloy achieved equilibrium.

Heat treated alloys, although visibly acceptable, may contain an unacceptable level of residual stress. If the part is subject to subsequent material removal (i.e., machining, drilling, or honing), it will warp or twist to relieve internal stresses. This reorientation of stress pattern normally results in part distortion. This warpage can significantly increase machining costs and can also lead to high rejection rates due to parts failure to meet dimensional tolerances.

The technique of uphill quenching comprises cooling a metal alloy part to a low temperature typically to cryogenic level at a high rate called quench-cooling. This is followed by rapid heating to a temperature level just below the artificial aging temperature of the particular metal alloy being treated. Uphill quenching operates by developing residual stresses of an opposite nature from the solution heat treatment and quenching of the metal alloy, by subjecting a very cold metal alloy part to rapid heating resulting in an uphill quench. Uphill quench, in order to be effective, must develop greater temperature differentials in the alloy part than obtained by conventional techniques. However, uphill quench cannot involve temperatures high enough to have an effect on the tensile properties of metal alloy. Therefore, in order to accomplish the maximum temperature differential to effect stress reduction by uphill quenching, the heating of the metal alloy part to be treated must be initiated at a very low temperature, thus dictating cold quench-cooling, preferably with a cryogen such as liquid nitrogen.

The present invention performs uphill quenching using vapor phase heating with fluorochemicals, preferably perfluorinated hydrocarbon fluids, for accelerating the heating stage of the uphill quench cycle. Perfluorinated hydrocarbon fluids lend themselves to uphill quenching due to their unique physical properties. A fixed boiling point below the specified aging temperature of the alloy, high rate of heat transfer, and high thermal stability allow for uniform temperature maintenance during vapor phase heating.

The term fluorochemical as used herein is defined as a compound having at least a single fluorine replacing hydrogen in a bond with the compound. Thus, fluorochemicals as used herein may include aromatic and nonaromatic hydrocarbons or corresponding heteroatom containing compounds with or without carbon, which have been at least partially fluorinated wherein at least some hydrogen is substituted with fluorine. The term perfluorocarbon as used herein, means a carbon compound which is fully fluorinated and has no unsaturation. Thus, perfluorocarbons contain carbon and fluorine without hydrogen. Because the nomenclature for this relatively new group of compounds has not been standardized and is subject to further developments, there is at least general agreement in the art that specific perfluorocarbons can be named by the nomenclature perfluoro, followed by an aromatic precursor designation. For example, perfluorophenanthrene actually is used to designate phenanthrene which has been completely deprived of hydrogen and unsaturating double bonds and comprises a fully fluorine substituted condensed ring structure of three cyclohexyl groups. Accordingly, for the purposes of this invention, the term perfluorocarbon will indicate total fluorine replacement and total saturation of any aromatic structure despite the use of aromatic nomenclature to designate the hydrocarbon precursor.

Examples of appropriate fluorochemicals that can be utilized in the present invention include, perfluorodecalin which boils at approximately 142° C., perfluoromethyldecalin which boils at approximately 160° C., perfluorodimethyldecalin which boils at approximately 180° C., perfluoroisopropyldecalin which boils at approximately 200° C., perfluorotetradecahydrophenanthrene which boils at approximately 215° C., perfluorodiisopropyldecalin which boils at approximately 240° C., perfluoro-1,1-bis(3,4 dimethylcyclohexyl) ethane, which boils at approximately 260° C., perfluorotributylamine, perfluorotripentylamine, perfluorotrihexylamine, perfluorotripropylamine. perfluoropolyethers having repeating units such as: $—(CF_2—CF(CF_3)O)_n—$; $—(CF_2—CF_2—O)_n(—CF_2O)_m$; and $—(CF_2—CF_2—CF_2O)_n$ where n is selected for an appropriate temperature range of the compounds boiling point, but can be 2–400.

The physical properties of perfluorocarbon fluids make them an ideal fit for uphill quenching of metal alloys. These fluids have tight boiling points and high thermal stability in the desired uphill quenching temperature range. The fluids are able to provide a uniform temperature for vapor phase heating. The fluids are classified as nonhazardous, and they do not provide any significant environmental concerns in the workplace. The uphill quenching temperature can be varied by selecting the appropriate perfluorinated fluid or mixtures thereof. The required uphill quenching time and temperature are specified by the applicable specification for the appropriate alloy.

The vapor phase heating process of the present invention differs from the prior art practice of uphill quenching, in that it uses a condensing fluorochemical vapor to heat the alloy instead of condensing steam from various steam nozzle configurations.

The alloys treatable by the present invention include most preferably the wrought and forged aluminum alloys such as those designated 2011, 2014, 2017, 2117, 2218, 2618, 2219, 2419, 2024, 2124, 2224, 2025, 2036, 4032, 6101, 6201, 6009, 6010, 6151, 6351, 6951, 6053, 6061, 6262, 6063, 6066, 6070, 7001, 7005, 7016, 7021, 7029, 7049, 7050, 7150, 7075, 7175(b), 7475, 7076, 7178, and other appropriate alloys of similar designation. Of particular interest is the aluminum alloy 7075. These aluminum alloys generally include the generic designation 2XXX, 6XXX and 7XXX. The cast alloys treatable by the present invention include most preferably the cast aluminum alloys, such as those designated 222, 242, 295, 296, 319, 336, 355, 356 and 712. These cast alloys generally have the generic designation 2XX, 3XX and 7XX.

The uphill quenching process is most typically a two step process in a multi-step treatment of metal alloys. This multi step treatment is typically referred to as precipitation strengthening or hardening and involves the following steps.

1. Solution heat treatment is the first step in the precipitation strengthening process. Sometimes this treatment is referred to as solutionizing. The alloy which may be in a wrought or cast form is heated to a temperature between the solvus and solidus temperatures and is soaked there until a uniform solid solution structure is produced.

2. Quenching is the second step in the precipitation strengthening process. The alloy is rapidly cooled to a low temperature, usually room temperature, and the cooling medium is usually water at room temperature. The structure of the alloy after water quenching consists of a super saturated solid solution. However, the alloy typically has high levels of residual stresses due to the differential cooling with the antagonistic forces of compressive and tensile stress within the alloy. Relief from this residual stress dictates the next step of the overall process.

3. Uphill quenching is a process wherein a part is quench-cooled to a very low temperature, usually with a cryogen such as liquid nitrogen, and then is rapidly heated to a temperature below the artificial aging temperature of the alloy while still obtaining the greatest surface to center temperature differential possible.

4. Aging is the last step in precipitation strengthening. Aging the solution heat treated, quenched and uphill quenched alloy is necessary so that a finely dispersed precipitate forms. The formation of a finely dispersed precipitate in the alloy is the objective of the precipitation strengthening process. The fine precipitate in the alloy impedes dislocation movement during deformation by forcing the dislocations to either cut through precipitated particles or go around them. By restricting dislocation movement during deformation, the alloy is strengthened. Aging the alloy at room temperature is called natural aging, whereas aging at elevated temperatures is called artificial aging. Most alloys require artificial aging and the alloy temperature is usually between about 15 to 25% of the temperature difference between room temperature and the solution heat treatment temperature.

The present invention is directed to uphill quenching as a part of the multi step process of precipitation strengthening as set forth above. The second step at the uphill quenching of the present invention is performed by heating the alloy in the condensing vapor produced from boiling the specified fluorochemical compound. As the fluorochemical compound boils at its designated boiling point in an appropriate containment device, a constant elevated temperature vapor of the fluorochemical forms above the boiling liquid. Condensing coils positioned above a workspace in the containment device keep the vapor restrained and return vapor by condensation to the liquid. The condensing coils can be powered by appropriate refrigeration or cooling water. A relatively lower temperature part or alloy to be heated in the uphill quench process is placed into the workspace of the containment device to be enveloped in the vapor of the boiling fluorochemical compound. The vapor condenses on the cooler part or alloy and imparts its heat of condensation to the alloy, thus heating it to accomplish the final step of the uphill quenching process.

The fluorochemical compound can be only a component of the vapor, but preferably is at least a significant component of the vapor. More preferably, the fluorochemical compound is a predominant component of the vapor. Optimally, the vapor consists essentially of the fluorochemical compound. Most optimally the vapor consists entirely of said fluorochemical compound.

The process of the present invention will be described with reference to an example of the preferred embodiment.

EXAMPLE 1

The vapor phase, uphill quenching of an aluminum alloy sample 7075, using the perfluorocarbon fluid, perfluoromethyldecalin was performed in a stainless steel tank wherein the perfluoromethyldecalin is heated and partially vaporized by electric conversion heaters. A water filled cooling coil is employed to condense any vapor which attempts to leave the stainless steel tank. The sample was first configured from a 2 inch by 6 inch by 12 inch 7075 aluminum block fitted with a ⅛" hole drilled into the center of the block to serve as a port for a type "T" thermocouple used to monitor the center temperature. Another type "T" thermocouple was fixed tangent to the surface by means of stainless steel wire. The aluminum block was then placed in a liquid nitrogen bath until the entire sample was at a uniform temperature of −320° F. (−196° C.). After equilibrium was achieved in the liquid nitrogen bath, the piece was transferred into the above identified vapor phase heating chamber partially filled with boiling liquid perfluoromethyldecalin with the remaining space comprising the boiled off vapor of perfluoromethyldecalin. The thermal gradient experienced by the sample was measured with the thermocouples and recorded. A temperature differential of 462° F. was observed with the vapor phase heating of the uphill quench process. This exceeds 371° F., which is the largest thermal gradient achieved in the literature using liquid nitrogen and high velocity steam. This demonstrates that the perfluoromethyldecalin can generate a temperature differential which exceeds those achieved with steam without raising the aluminum alloy over the minimum aging temperature of 310° F. (155° C.).

The process of vapor phase, uphill quenching, exemplified in Example 1 above, produces stresses equal and opposite to the residual stresses in the part by applying a reverse thermal treatment to the alloy. The contrapositive of the above argument holds true when the surface is put into tension with the center in compression and the exterior in a tensile state.

Addition of the two residual stress components from the two thermal cycles, quenching and uphill quenching, results in a net residual stress of zero. Although zero residual stress is a claim only achieved in theory, experimentally residual stress has been reduced more than 80% in the prior art when an uphill quench is employed.

Stress can be measured using standard techniques such as ASTM E837-85, ASTM E328-86 and ASTM E915-85. In the technique E837-85, a strain gage in the form of a three element rosette is attached to the subject material and a hole is drilled near the gage in the material to a depth slightly greater than the hole diameter. The strain relief is measured using known computational relationships. The percent stress relief is the calculated stress relief as a percentage of original residual stress.

In Table 1 below the improvement of the present invention over the known prior art is set forth showing a decided improvement in stress relief of metal alloys over the prior art techniques.

Figure 1:
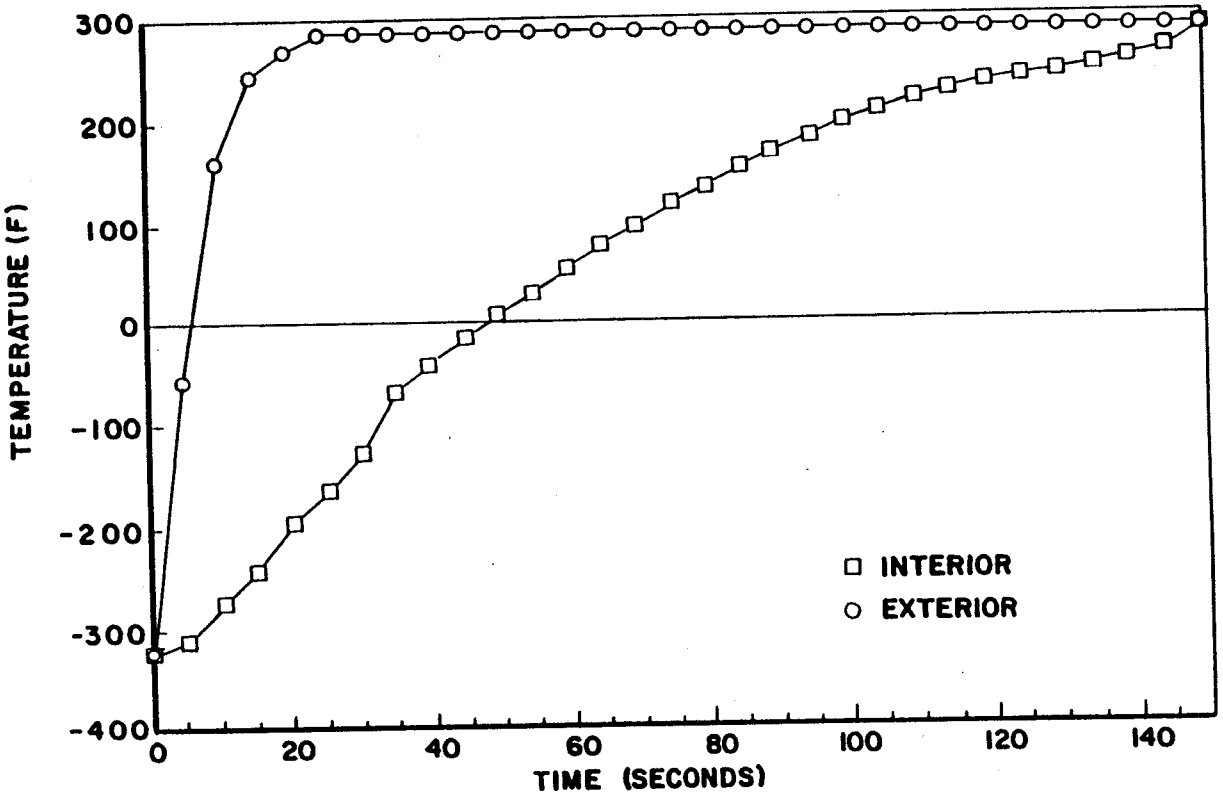
FIG. 1 is a graphical representation of Run I of the experimental example of the present invention wherein a 2"×6"×12" 7075 aluminum alloy was uphill quenched using liquid nitrogen followed by vapors of boiling perfluoromethyldecalin.
Figure 2:
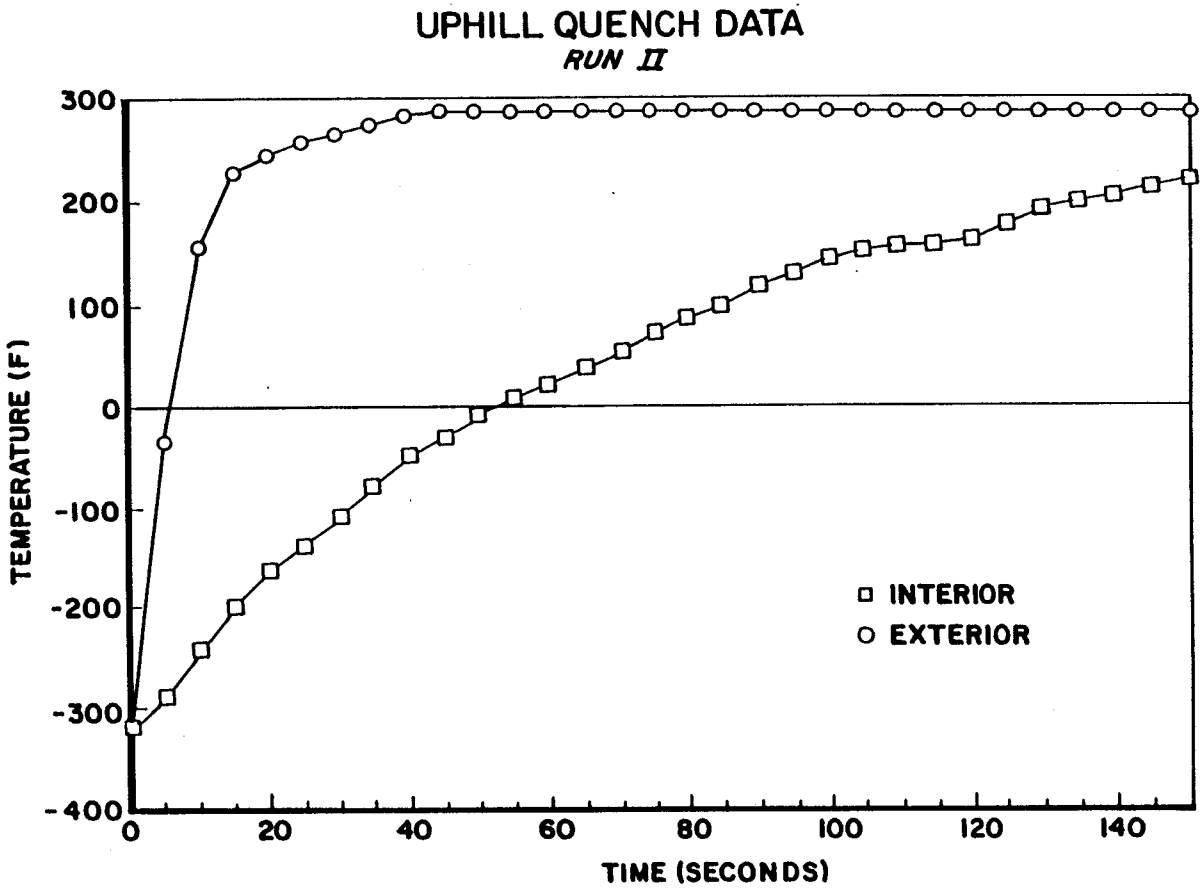
FIG. 2 is a graphical representation of a Run II of the same experimental mental procedure as FIG. 1 above.
Figure 3:
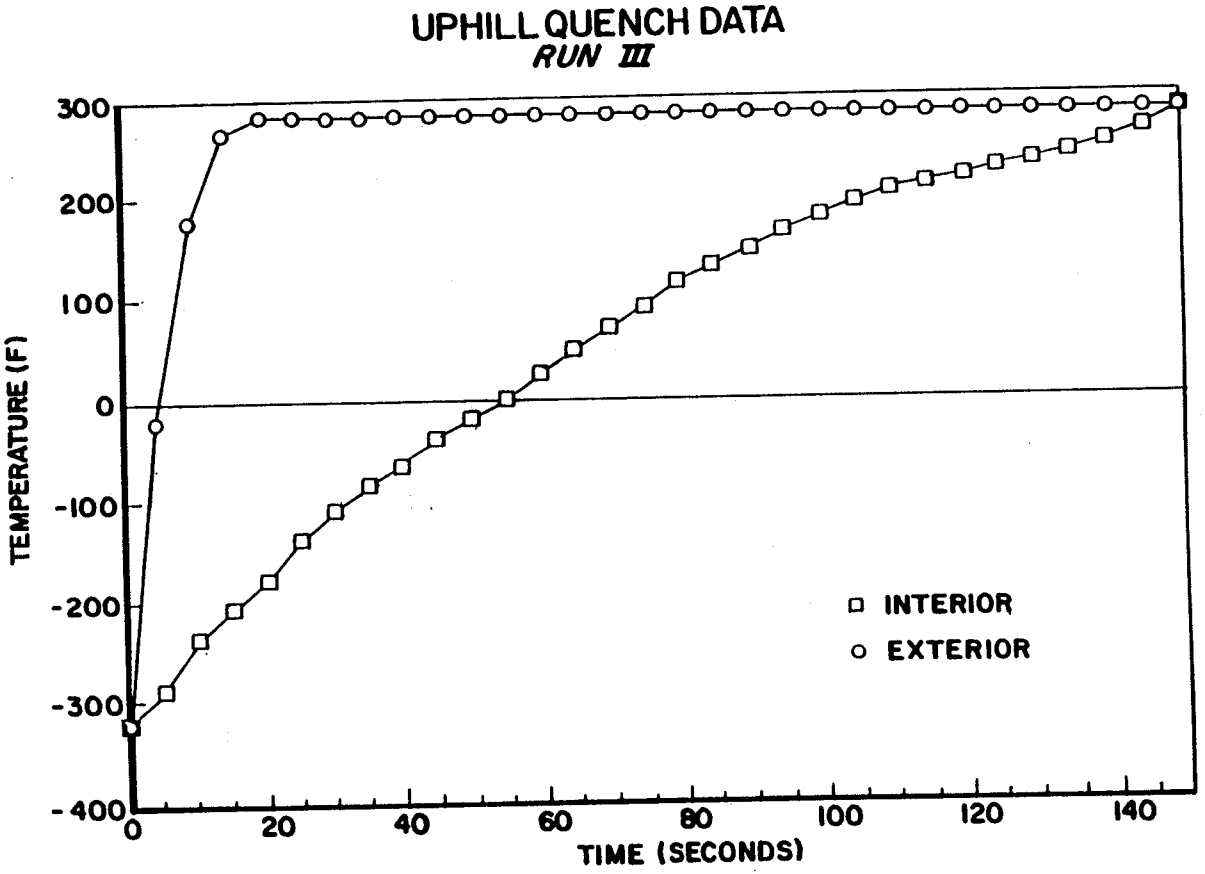
FIG. 3 is graphical representation of a Run III of the same experimental mental procedure as FIG. 1 above.

In the three experimental runs of the present invention reported in Table 1, to demonstrate the percent residual stress reduction in a part of 7075 aluminum alloy having a dimension of 2"×6"×12" was fitted with a thermocouple placed in a hole drilled in the center of the part and a thermocouple attached in a 1/16" deep indent in the surface of the part and subjected to uphill quenching wherein the part was cooled to less than −300° F. and immediately heated in the vapor of a boiling liquid bath of perfluoromethyldecalin which boils at approximately 320° F. Three separate runs of this experiment were performed achieving maximum temperature differentials of 487° F. for Run I, 428° F. for Run II and 472° F. for Run III. These runs are graphically illustrated in FIGS. 1 through 3. respectively. The maximum temperature differentials were then correlated in accordance with the graphical representation deduced by H. N. Hill, et al. and reproduced in FIG. 4 which shows temperature differential as a function of percent reduction in residual stress. Extrapolation on this graph resulted in the finding in Table 1 below of >90% reduction in residual stress.

The graph in FIG. 4 was produced by the technique set forth in the article identified at page 2 of the present application to Hill et al. Those authors describe an experimental protocol in which parts were machined and the deformation was measured with the amount of deflection being representative of residual stress. Similar parts were then subjected to uphill quench, machined and the amount of deformation was again measured. The degree of deflection was correlated against the first set of parts to calibrate the effectiveness of uphill quenching in reduction of residual stresses as demonstrated by the diminishment in deflection after machining. Therefore, the relationships deduced in FIG. 4 are also valid for the uphill quenching of the present invention.

TABLE 1

| Method | Temperature Differential (°F.) | Percent Reduction in Residual Stress |
|---|---|---|
| Liquid Nitrogen > Perfluoromethyldecalin, Run I** | 487 | >90% |
| Liquid Nitrogen > Perfluoromethyldecalin, Run II** | 428 | >90% |
| Liquid Nitrogen > Perfluoromethyldecalin, Run III** | 472 | >90% |
| Liquid Nitrogen > Steam (high velocity)* | 371 | 82% |
| Dry Ice > Steam (high velocity)* | 219 | 48% |
| Liquid Nitrogen > Steam (low velocity)* | 244 | 44% |
| Liquid Nitrogen > Boiling Water* | 110 | 19% |
| Dry Ice > Boiling Water* | 110 | 19% |

*Prior Art
**Present Invention

Accordingly, the present invention provides a unique workable alternative for uphill quenching, which overcomes the drawbacks of the prior art with their constraints on maximum temperature and their mechanical problems in arranging appropriate steam spray and difficulty in uniform heating of oddly configured parts. The present invention provides high levels of temperature differential in a uniform heating medium which does not require reconfiguration for different geometry parts while providing for fast, continuous, multi-part processing using an inert, non-toxic working fluid, which is far superior to the high velocity steam of the prior art. These attributes provide a unique enhancement over the prior art uphill quenching technique for the processing of metal alloys, particularly aluminum alloys.

The present invention has been set forth with regard to a preferred component and a preferred embodiment, but the full scope of the present invention should be ascertained from the claims which follow.

We claim:

1. In a process for uphill quenching of metal alloys to relieve residual stresses, the improvement comprising, after quench-cooling said metal alloy, heating said metal alloy by the elevated temperature vapor of a fluorochemical compound.

2. The process of claim 1 wherein said alloy has initially been solution heat treated and quenched.

3. The process of claim 1 wherein said metal alloy is an aluminum alloy.

4. The process of claim 1 wherein said fluorochemical is a perfluorocarbon.

5. The process of claim 4 wherein said perfluorocarbon is selected from the group consisting of perfluorodecalin, perfluoromethyldecalin, perfluorodimethyldecalin, perfluoroisopropyldecalin, perfluorotetradecahydrophenanthrene, perfluorodiisopropyldecalin and perfluoro-1,1-bis (3,4-dimethylcyclohexyl) ethane.

6. The process of claim 1 wherein said alloy is selected from the group consisting of 2XXX aluminum alloys, 6XXX aluminum alloys, and 7XXX aluminum alloys.

7. The process of claim 1 wherein said alloy is selected from the group consisting of aluminum alloyed with copper, aluminum alloyed with magnesium and silicon, and aluminum alloyed with zinc, magnesium and copper.

8. The process of claim 1 wherein the alloy is 7075 aluminum alloy.

9. The process of claim 1 wherein the uphill quenching is performed at a maximum temperature up to the range of approximately 148.89° to 176.67° C. (300° to 350° F.).

10. The process of claim 1 wherein the fluorochemical compound is perfluoromethyldecalin.

11. The process of claim 1 wherein said alloy is selected from the group consisting of 2XX aluminum cast alloys, 3XX aluminum cast alloys and 7XX aluminum cast alloys.

12. The process of claim 1 wherein said uphill quenching is performed by the condensation of the vapor phase fluorochemical on the relatively cooler alloy which imparts the heat of condensation to the alloy from the fluorochemical.

13. The process of claim 1 wherein the quench-cooling is performed with a cryogen.

14. The process of claim 1 wherein the quench-cooling is performed with liquid nitrogen.

15. The process of claim 1 wherein the uphill quenching is performed at a maximum temperature below the temperature for artificial aging of the metal alloy being treated.

16. The process of claim 1 wherein the fluorochemical compound is a significant component of said vapor.

17. The process of claim 1 wherein the fluorochemical compound is the predominant component of said vapor.

18. The process of claim 1 wherein said vapor consists essentially of said fluorochemical compound.

19. The process of claim 1 wherein said vapor consists of said fluorochemical compound.

* * * * *